US005243355A

United States Patent [19]

Emmert et al.

[11] Patent Number: 5,243,355

[45] Date of Patent: Sep. 7, 1993

[54] SEMIAUTOMATIC RETRACTABLE ANTENNA APPARATUS

[75] Inventors: Steven C. Emmert, Arlington Heights; Kenneth W. Carlson, Hawthorn Woods; Nicholas Mischenko, Mt. Prospect, all of Ill.

[73] Assignee: Motorola, Inc., Schaumburg, Ill.

[21] Appl. No.: 976,013

[22] Filed: Nov. 13, 1992

Related U.S. Application Data

[63] Continuation of Ser. No. 663,974, Mar. 4, 1991, abandoned.

[51] Int. Cl.[5] ..... H01Q 1/24; H01Q 1/36

[52] U.S. Cl. ..... 343/702; 343/895

[58] Field of Search ..... 343/702, 889, 883, 900, 343/901, 903, 895; 455/351, 347, 89, 90

[56] References Cited

U.S. PATENT DOCUMENTS

| | | | |
|---|---|---|---|
| 2,491,629 | 12/1949 | Vernier et al. | 343/901 |
| 3,154,785 | 10/1964 | Taylor | 343/889 |
| 4,121,218 | 10/1978 | Irwin et al. | 343/702 |
| 4,725,845 | 2/1988 | Phillips | 343/895 |

*Primary Examiner*—Michael C. Wimer
*Assistant Examiner*—Hoanganh Le
*Attorney, Agent, or Firm*—Kevin D. Kaschke

[57] ABSTRACT

An antenna apparatus for a radiotelephone (100) comprises a shroud (207), an antenna (209) and releasable latch means (231, 219, 223, 229). The shroud (207) is movable between a first and a second position. The antenna is an extendable helical coil (209) having a shortened axial length when the shroud is moved to the first position and a lengthened axial length when the shroud is moved to the second position. The extendable helical coil (209) exerts biasing forces on the shroud (207) when the shroud is moved to the second position to urge the shroud (207) towards the first position. The releasable latch means, including a platform (205) having a flexible end portion (231) adapted for cooperative engagement with the shroud (207), latches the shroud (207) at the second position when the shroud (207) is moved to the second position and releases the shroud (207) from the second position, responsive to flexing the flexible end portion (231), permitting the biasing forces to return the shroud (207) to the first position.

21 Claims, 5 Drawing Sheets

SEMIAUTOMATIC RETRACTABLE ANTENNA APPARATUS

This is a continuation of copending application Ser. No. 07/663,974, filed on Mar. 4, 1991, now abandoned.

FIELD OF THE INVENTION

This invention relates generally to the transmission and reception of radio frequency signals with an antenna and, more particularly, to an apparatus enabling the antenna to be semiautomatically retractable into a housing.

BACKGROUND OF THE INVENTION

An antenna is that part of a transmitting or receiving system which is designed to radiate or to receive electromagnetic radio waves. Optimal performance for radio systems such as cellular and cordless radiotelephones is obtained when a antenna protrudes into free space away from a housing which encloses the radio system. For such radiotelephones the antenna is typically at least as long as the housing containing the radiotelephone. The portability of a radiotelephone is comprised when permanently affixed in its protruding position outside the radiotelephone's housing. To improve the portability of radiotelephone when its not in use, mechanisms have been devised which enable the operator to easily disconnect the antenna or to conceal the antenna within the radiotelephone's housing. The mechanisms usually require the radiotelephone operator to manually alter the position of the antenna with respect to the radiotelephone. Additionally, damaged antennas which are concealed within the radiotelephones housing usually cannot be replaced by the operator without opening the radiotelephone's housing.

A conventional mechanism for coupling an antenna to a radiotelephone is used on a Motorola portable cellular radiotelephone model number 980XL. The mechanism, a standard BNC radio frequency connector, enables the operator to easily disconnect a fixed helical antenna for increased portability or connect the antenna to use the radiotelephone.

A similar mechanism is used on a cordless radiotelephone manufactured by Sanyo (model number CLT8801). The mechanism uses a conventional threaded radio frequency connector to connect or disconnect a fixed helical antenna. The conventional mechanism used with the Sony cordless radiotelephone and the aforementioned Motorola cellular radiotelephone require manual coupling and decoupling of the antenna to the radiotelephone. This presents an operating inconvenience to the operator and the potential for the operator to lose the antenna when it is detached. An advantage of these coupling mechanisms, however, is that the operator can easily replace a damaged antenna without opening the radiotelephone's housing.

A mechanism which enables an antenna to be concealed within the radiotelephone's housing is used on a cordless telephone manufactured by AT&T (model number 4600). The mechanism uses a conventional telescoping metal antenna. To use the radiotelephone, the operator manually extends the telescoping antenna. When the radiotelephone is not in use, the operator manually retracts the telescoping antenna. If the antenna is damaged, the operator can replace the telescoping mechanism by accessing a conventional threaded connector on the outside of the radiotelephone's housing. Although the telescoping antenna mechanism is operator replaceable and concealed within the radiotelephone when not in use, manual extension and retraction of the antenna is inconvenient for the operator.

A second mechanism which enables an antenna to be concealed within a radiotelephone housing is used on a cordless radiotelephone manufactured by Panasonic (model number KX-T3725). The operator is required to manually extend or retract a fixed helical antenna. The electrical connection between the fixed helical antenna and the radiotelephone is aided by an extension coiled antenna. Although this antenna mechanism allows the convenience of concealing the antenna within the radiotelephones housing, the antenna is not operator replaceable without opening the radiotelephone's housing and the manual positioning of the antenna is an operator inconvenience.

A third mechanism enabling an antenna to be concealed within a cordless radiotelephone is also manufactured by Panasonic (model number KX-T4000). To extend the antenna the operator is required to release a latch enabling the antenna to actively project away from the radiotelephone's housing. The semiautomatic extension of the antenna is a hazard for a device which is normally used in close proximity with an operator's eyes. Although the antenna can be conveniently concealed within the cordless radiotelephone's housing, the antenna cannot be replaced by the operator without opening the radiotelephone's housing.

A formidable challenge, therefore, is to develop an antenna for portable radio systems which can be concealed within the radio system's housing, is operator replaceable without opening the radiotelephone's housing and can be semiautomatically retracted inside the radiotelephone's housing for operator convenience.

SUMMARY OF THE INVENTION

An antenna apparatus comprises a shroud, an antenna and releasable latch means. The shroud is movable between a first and a second position. The antenna has a first physical dimension when the shroud is moved to the first position and a second physical dimension when the shroud is moved to the second position. The antenna exerts biasing forces on the shroud when the shroud is moved to the second position to urge the shroud towards the first position. The releasable latch means, including a platform having a flexible end portion adapted for cooperative engagement with the shroud, latches the shroud at the second position when the shroud is moved to the second position and releases the shroud from the second position, responsive to flexing the flexible end portion, permitting the biasing forces to return the shroud to the first position.

DETAILED DESCRIPTION OF THE PREFERRED EMBODIMENT

Figure 1:
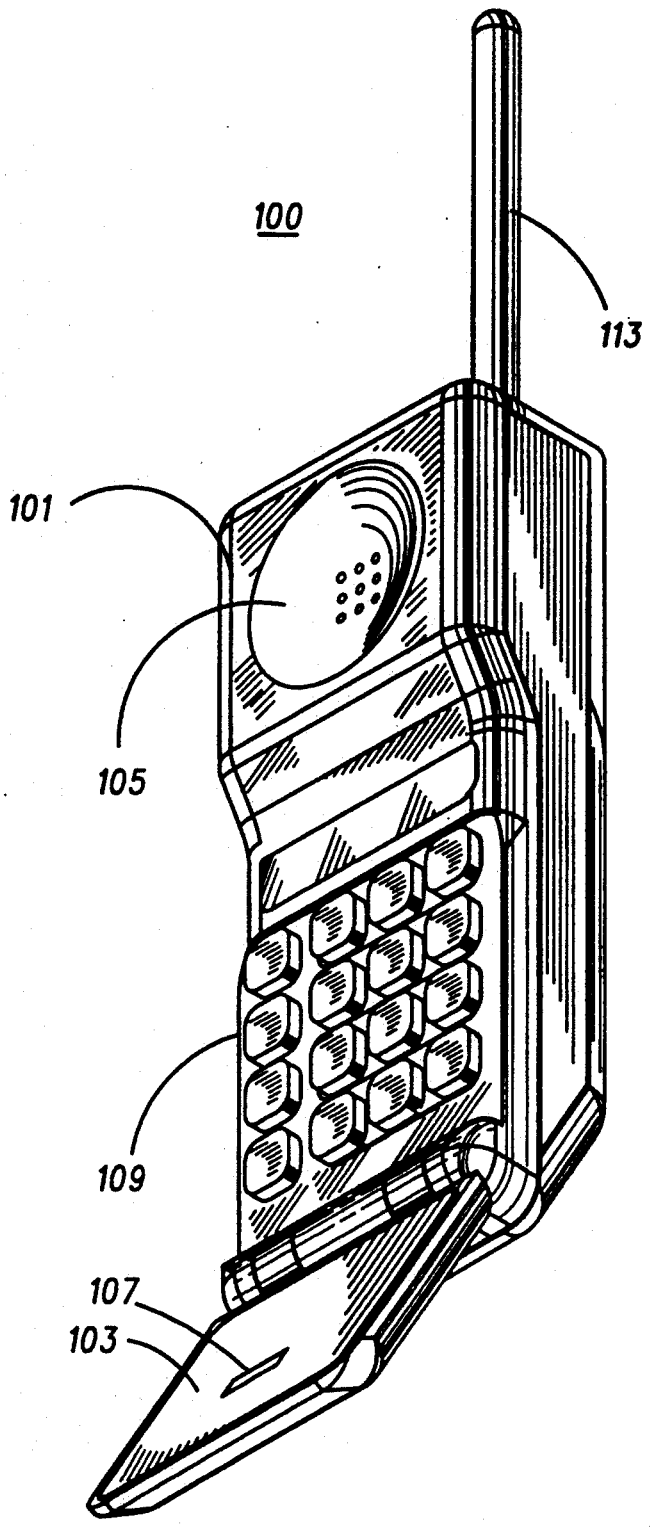
FIG. 1 is an isometric drawing of a cordless radiotelephone handset constructed in accordance with the present invention.

A portable radiotelephone handset adapted for use in a cordless radiotelephone system is shown in FIG. 1. The present invention may be employed in such a portable radiotelephone handset as well as in other miniature electronic equipment. The illustrated portable unit consists of two external portions, a body portion 101 and a flip element portion 103. The drawing of FIG. 1 shows the flip element 103 in an "open" position such that the user of the portable unit may listen via earpiece 105 and may speak into a microphone 107. A telephone dial, or keypad 109, consists of a plurality of buttons numbered 1 through 0, #, and *, in a familiar telephone arrangement. The keypad 109 also has additional function buttons such as volume, flash, scan and other buttons associated with telephone number recall.

Since the portable radiotelephone of FIG. 1 is indeed portable, an antenna 113 is required to couple voice and data signals between the portable radiotelephone and a remote base station. Signal transmit and receive performance is optimized by manually extending the antenna outside of its concealed position within the radiotelephone's housing. When the portable radiotelephone is not in use, the operator may conveniently depress a button on the back of the radiotelephone 100 which automatically retracts the antenna 113 into the radiotelephone 100. A semiautomatic retractable antenna offers the operator convenience and increased portability of the portable radiotelephone 100. Furthermore, a novel feature of the antenna 113 gives the operator the opportunity to replace the antenna 113 without opening the portable radiotelephone 100.

Figure 2:
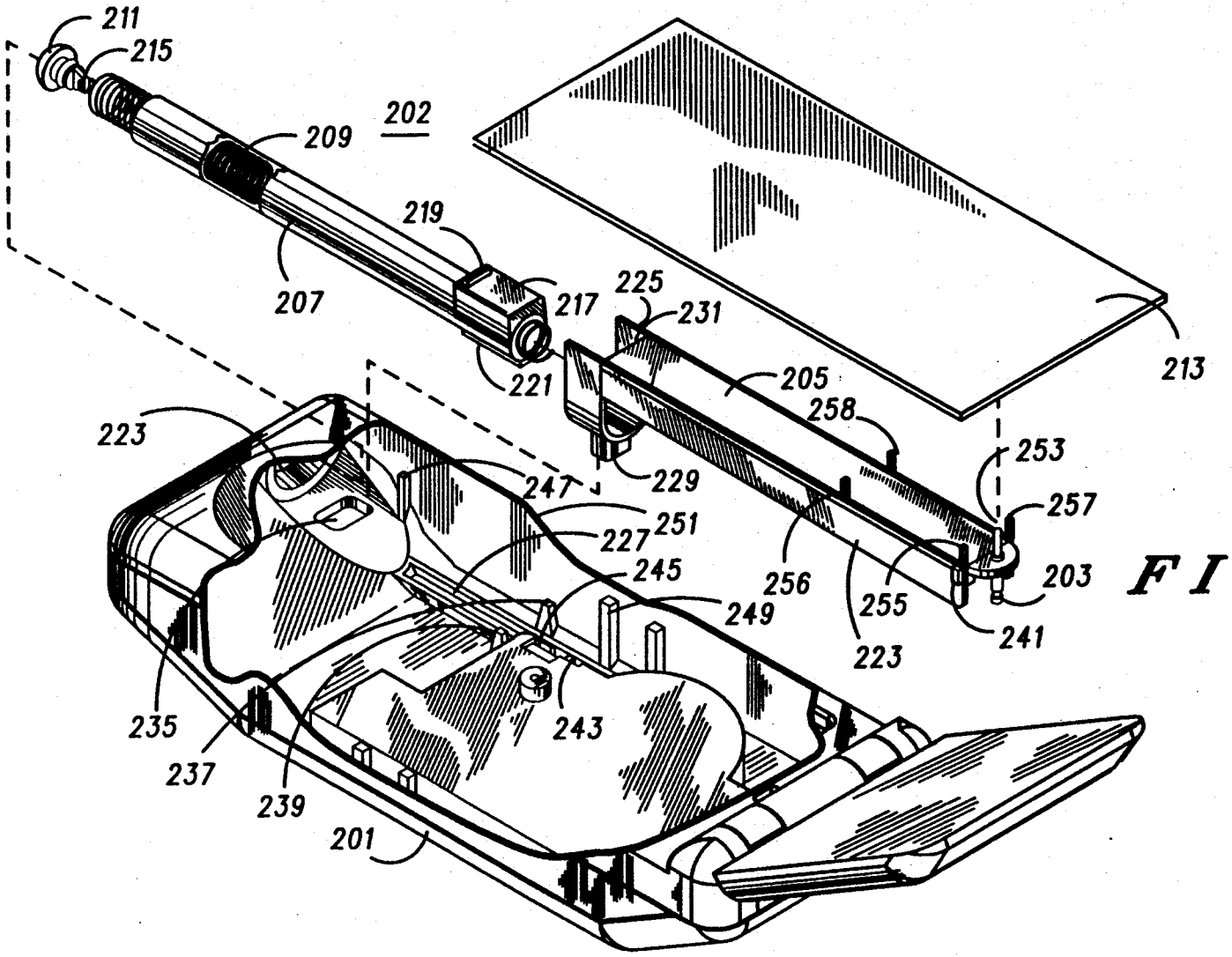
FIG. 2 is an exploded view from a first perspective of an antenna mechanism included in the radiotelephone's handset of FIG. 1.

Referring now to FIG. 2, there is shown an exploded view from a first perspective of a novel antenna mechanism within the rear housing 201 of the portable radiotelephone 100 as shown in FIG. 1. In the first preferred embodiment of the present invention, the semiautomatic retractable antenna mechanism consists of 5 parts: a pin 203, a platform 205, a shroud 207, an antenna coil 209, and a cap 211. The antenna mechanism 202 is captivated between the rear housing 201 and a printed circuit board (pcb) 213.

The antenna mechanism 202 is assembled by placing the shroud 207 on the platform 205. One end of the antenna coil 209 is attached to an eyelet 215 underneath the cap 211. The cap is conventionally molded with ABS material. The antenna coil is then fed through the center of the shroud 207. The opposite end of the antenna coil 209 is attached to a pin 203 using conventional soldering techniques. In the first preferred embodiment, the pin 203 is press-fit into a hole into the platform 205. Other assembly techniques may also be used such as insert molding. The platform is conventionally molded with polycarbonate material. The cap 211 is snapped into the end of the shroud 207 utilizing conventional interlocking molding techniques.

The antenna coil 209 forms a helical antenna. Cordless radiotelephones typically operate within a frequency bandwidth of 46 to 50 MHz. Optimal antenna performance at this frequency bandwidth is achieved using a quarter wavelength antenna. A quarter wavelength monopole antenna (straight wire) operating at 48.25 MHz is 155 centimeters long. The monopole antenna of 155 centimeters would be far too long for practical use with a portable cordless radiotelephone. Therefore, wire is wound in a helical pattern in order to gain physical antenna wire length without increasing the length of the antenna shroud 207. Other factors contributing to a helical antenna's performance include: wire diameter, coil diameter, pitch and number of coils. Physical dimensions of the antenna coil 209 include: a wire diameter of 0.33 mm, a coil diameter 5.0 mm, a pitch between adjacent antenna coils of 0.76 mm, and 200 number of coils. According to the first embodiment of the present invention, the antenna coil 209 exhibits spring like characteristics. The antenna coil 209 is composed of a phosphor-bronze alloy material with a silver plating. The silver plating inhibits corrosion and oxidation of the antenna coil 209. The antenna coil 209 is partially extended when the shroud is retracted inside the radiotelephone 100 and further extended when the shroud 207 is pulled outside the radiotelephone 100.

In the first preferred embodiment of the present invention, the shroud 207 is molded from estane to give the shroud 207 flexibility. Physical features of the shroud include a guide 217, a ledge 219 and a protrusion 221. The guide 217 gives that portion of the otherwise cylindrical shroud 207 rectangular characteristics. The guide 217 in combination with the protrusion 221 prevent the shroud 207 from spinning along the axis containing the antenna coil 209. This is accomplished by confining the guide 217 between two opposing walls 223 and 225 (opposite 223), and by confining the protrusion 221 within a groove 227 within the rear housing 201. It is important to fix the rotational orientation of the shroud 207 within the radiotelephone 100 so that the operator could not mistakenly spin the shroud thereby coiling or uncoiling the antenna coil 209 contained within. This rotational movement could cause damage to the antenna coil 209 and change the antenna's tuning characteristics. A second function for the protrusion 221 on the shroud 207 is to confine the maximum extension of the shroud 207 along the platform 205. The full extension of the shroud 207 is reached when the protrusion 221 interferes with a protuberance 229 on the platform 205. Upon full extension of the shroud 207, the ledge 219 on the shroud 207 becomes mechanically engaged with an edge 231 of the platform 205. Further details of this novel latching and retracting mechanism will be discussed in detail with FIG. 4*a* and 4*b*, and FIG. 5*a* and 5*b*.

After the antenna mechanism 202 is assembled it can easily be secured within the rear housing 201. The end of the shroud 207 containing the cap 211 is fed through an antenna aperture 233 in the rear housing 201 until the protuberance 229 on the platform 205 falls within a protuberance aperture 235 in the rear housing 201. The antenna mechanism 202 is then lowered into the rear housing 201 until walls 223 and 225 of the platform 205 rest on corresponding supports 237 and 239 within the rear housing 201. Consequently, the protrusion 221 on the shroud 207 is aligned within the groove 227 in the rear housing 201. To maintain alignment along the axis of the antenna coil 209, a key member 241 as part of the platform 205 is disposed within a channel 243 in the rear housing 201. A snap 245 in the rear housing secures the platform 205 and therefore the entire antenna mechanism 202 in place. Spacers 247 and 249 distance the antenna mechanism 202 from a side wall 251 of the rear housing 201. A benefit of the aforementioned assembly technique is that no tools or fasteners are required, thereby reducing assembly time and material costs.

The pcb 213, having the radiotelephone circuitry, is positioned over the antenna mechanism 202 within the rear housing 201 such that the pin 203 on the platform 205 is electrically mated to a socket 253 on the printed circuit board 213. The pin 203 and socket 253 provide a conventional connector for coupling radiotelephone signals to and from the pcb 213 and the antenna coil 209. The pcb 213 rests on four legs 255 through 258 on the platform 205. The purpose of the legs 255 through 258 will be described in FIG. 3, FIG. 4 and FIG. 5.

Figure 3:
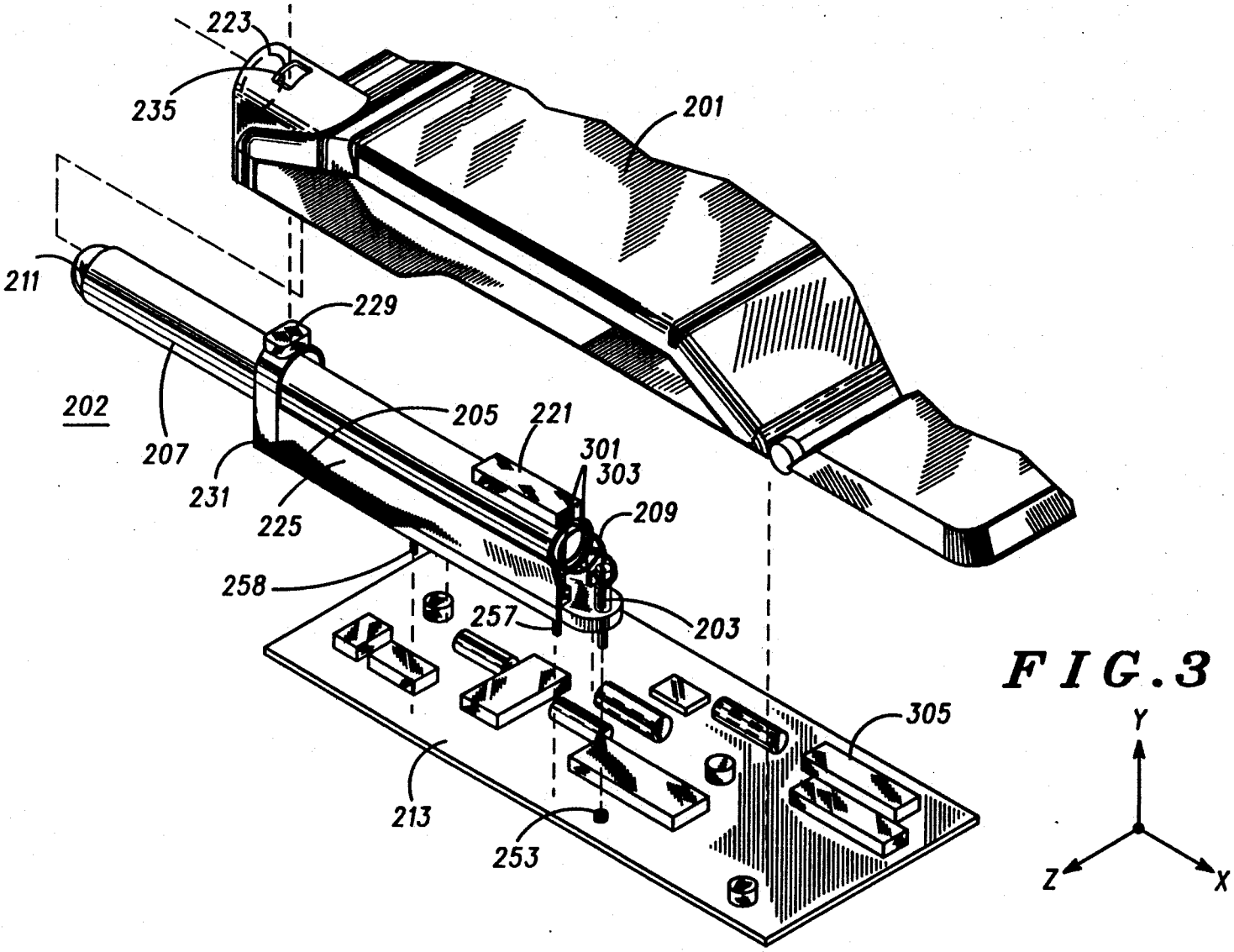
FIG. 3 is an exploded view from a second perspective of an antenna mechanism included in the radiotelephone handset of FIG. 1.

Now referring to FIG. 3, there is shown an exploded view from a second perspective of the antenna mechanism 202 within the radiotelephone 100. This second perspective clearly illustrates the top view of the shroud 207, the platform 205, the pcb 213, and the rear housing 201. The novelty of the first embodiment of the present invention resides in the ability of an operator of the radiotelephone 100 to depress the protuberance 229 extending through the protuberance aperture 235 in the rear housing 201 causing an extended shroud 207 to automatically retract into the portable radio telephone 100. The invention uses a unique latch mechanism to retain the shroud in its extended position and a unique release mechanism retracting the extended shroud 207 within the radiotelephone 100.

An additional feature shown in this second perspective beyond those features of FIG. 2 is the location of two stops 301 and 303 attached to walls 225 and 223, respectively, on the platform 205. The stops 301 and 303 are positioned near the pin 203 to limit the retraction of the shroud 207.

One purpose of the legs on the platform 255 through 258 is to distance the platform 205 away from the component surface of the pcb 213 so that components 305 may be positioned on the pcb 213 underneath the platform 205. Space utilization of the pcb 213 surface area is critical for portable radiotelephones.

Figure 4B:
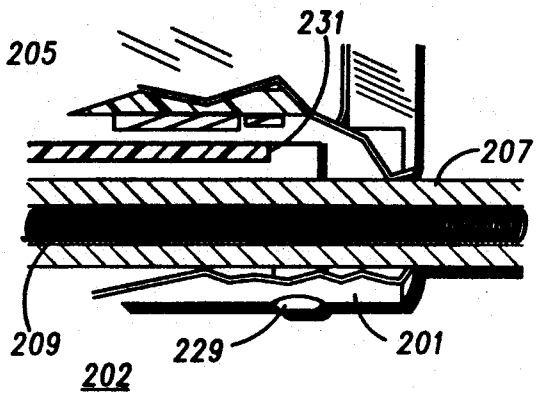
FIG. 4*b* is a blown up cross-sectional view of a portion of FIG. 4*a* of the antenna in its retracted state within the radiotelephone housing of FIG. 1.
Figure 4A:
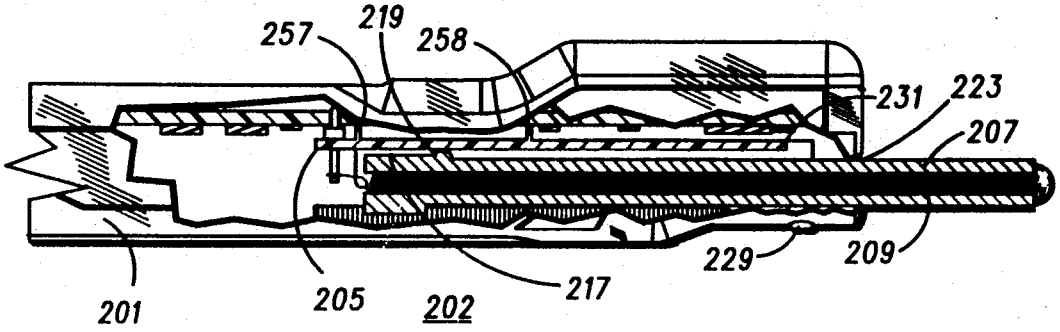
FIG. 4*a* is a cross-sectional view of the antenna in its retracted state within the radiotelephone housing of FIG. 1.

Now referring to FIG. 4*a* and 4*b*, there are shown, a cross-sectional views of the antenna mechanism 202 within the rear housing 201 with the shroud 207 in its retracted position. It is very important that the antenna coil 209 as shown not be fully compressed. A slight pitch between adjacent coils is required to maintain the full electrical length of the retracted antenna coil 209 because the antenna wire is not insulated. Also note that when the shroud 207 is fully retracted, a portion of the shroud 207 extends outside the rear housing 201. To extend the antenna shroud 207 for optimal radiotelephone performance the operator simply pulls the exposed portion of the shroud 207 outward until the shroud latches into place. The novel latching mechanism is an engagement of the edge of the platform 231 and the ledge of the shroud 219. The platform 205 is stationary along the axis of the shroud 207 but the edge of the platform 231 may flex in a direction perpendicular to the shroud 207 when the protuberance 229 is pressed in a downward direction. The platform 205 can flex because of the position of the legs 255 and 256, the distance from the edge to the first set of legs 256 and 258, the material thickness of the platform 205 and the thickness of platform 205. As the shroud 207 is extended, the ledge 219 slides along the platform 205 causing the edge of the platform 231 to be slightly flexed. When the ledge of the shroud 219 moves past the edge of the platform 231, the edge 231 springs back to its original, unflexed, position thereby filling the void next to the ledge on the shroud 207. The shroud 207 is now locked into its extended position. It is necessary for the shroud aperture 223, protuberance 229, ledge of the shroud 219 and the edge of the platform 231 to be within close proximity of each other for secure latching to occur.

Figure 5B:
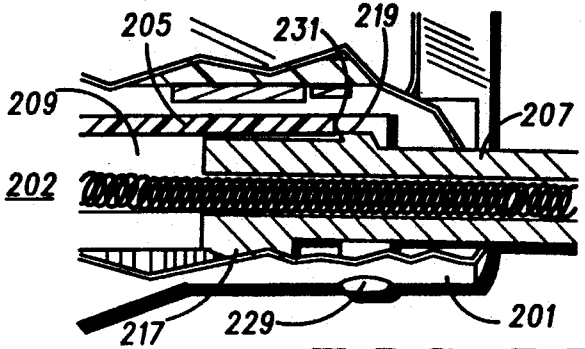
FIG. 5*b* is a blown up cross-sectional view of a portion of FIG. 5*a* of the antenna in its extended position outside the radiotelephone housing of FIG. 1.
Figure 5A:
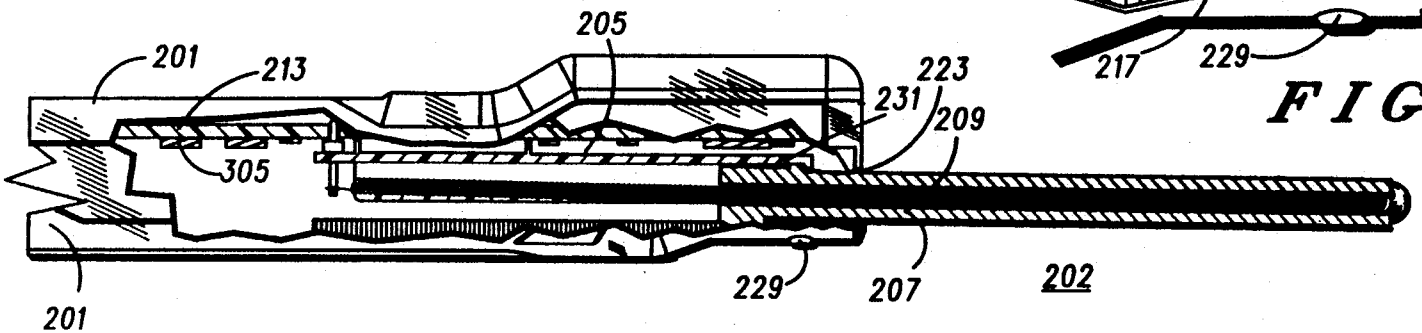
FIG. 5*a* is a cross-sectional view of the antenna in its extended position outside the radiotelephone housing of FIG. 1.

FIG. 5*a* and 5*b* are cross-sectional views of the antenna mechanism within the rear housing 201 when the shroud 207 is fully extended. The extended shroud 207, stretches the antenna coil 209 thereby creating spring-like potential energy for the antenna coil 209 to retract. The novel release mechanism which enables the shroud 207 to automatically retract includes important features on both the platform 205 and the shroud 207. The shroud 207 can easily and conveniently be retracted into the rear housing 201 by depressing the protuberance 229 extending outside of the rear housing 201. Depressing the protuberance 229 causes the platform to deflect in a downward direction towards the pcb 213. The shroud 207, however, remains in a fixed position along the same direction by the shroud aperture 223 in the rear housing. Therefore, as the protuberance 229 is depressed, the edge of the platform 231 is disengaged from the ledge 219 on the shroud 207 thereby allowing the antenna coil to recoil retracting the shroud 207 inside the rear housing 207.

One can more fully appreciate this semiautomatic retractable antenna invention by considering the simple but effective latch and release mechanism while taking advantage of the spring-like characteristics of a helical shaped antenna coil 209 and the platform 205. The novel latch and release mechanism included in the antenna mechanism 202 uses a minimum number of parts. The antenna 209 can be retracted using the same hand which holds the radiotelephone. The present invention described in the first preferred embodiment is far less complicated than most latch and release mechanisms. Advantages of such an effective concept include convenient assembly, low parts count, minimum opportunity for a defective latch and operator convenience for enhanced portability of the radiotelephone 100.

Figure 6:
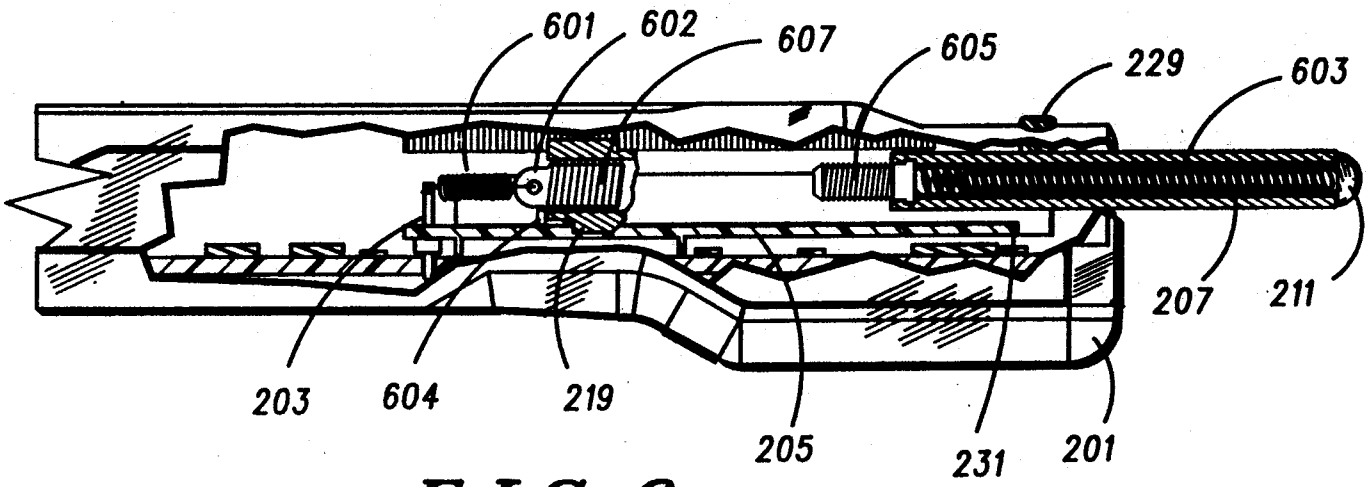
FIG. 6 is a cross-sectional view of a second embodiment of the present invention within the radiotelephone housing of FIG. 1.

Now referring to FIG. 6, there is shown, a cross-sectional view of the second embodiment of the invention. The second embodiment differs from the first embodiment in that it has an extension antenna coil 601 and a fixed antenna coil 603 coupled together by a conventional threaded shaft 605 and threaded inserts 607. The inventive latch and release mechanism for semiautomatically retracting the antenna shroud remains the same. The advantage of the second embodiment of the invention is that the antenna shroud accessible to the operator can be easily replaced without opening the radiotelephone 100. The operator can simply unscrew the shroud 207 thereby disconnecting the shroud 207 from the threaded insert 607 and replace it with a new shroud 207. The advantage of an operator replaceable antenna is paramount for a portable device such as this cordless radiotelephone. Portable devices are often dropped from heights of 4 feet or more. It is not uncommon for either the shroud of the antenna or the antenna coil to be damaged from such a drop. The damage may reduce the electrical efficiency of the fixed antenna coil 603, inhibit the mechanical positioning of the shroud 207 within the rear housing 201 or lower the aesthetics of the antenna shroud 207 outside the radiotelephone 100.

To retain the novel latch mechanism the ledge 219 which used to be part of the shroud 207 is now a part of the threaded insert 607. In the same manner as described in the first embodiment, the ledge mechanically engages the edges of the platform 231 thereby retaining the shroud 207 in its extended position. To retract the extended shroud 207 the protrusion 229 is depressed thereby deflecting the edge of the platform 231 towards the pcb 213 thereby disengaging the ledge 219 from the edge of the platform 231. The recoil of the extension antenna coil 601, attached to eyelet 602 on one end and the pin 203 one the other end, retracts the antenna shroud within the radiotelephone 100. A stop 604 prevents the threaded insert 607 from retracting to the point of having the extension coils short out.

Several advantages are gained by using a fixed antenna coil 603 within the shroud 207. One advantage is that the fixed antenna coil 603 provides an easier electrical match between the antenna and the receiver. Fixed antenna coils are easier to tune than extension antenna coils. A second advantage is that the fixed antenna coil 603 uses a much heavier weight wire than the extension antenna coil 601. Therefore, an extended antenna is less likely to be damaged outside of the radiotelephone because the heavier wire provides durability.

Therefore, a mechanism providing a unique semiautomatic retractable antenna and a retractable antenna which is operator replaceable is disclosed.

What is claimed is:

1. An antenna apparatus comprising:

a shroud moveable between at least a first and a second position;

a first antenna portion having a first physical dimension when the shroud is moved to the first position and a second physical dimension when the shroud is moved to the second position, and exerting biasing forces on the shroud when the shroud is moved to the second position to urge the shroud towards the first position; and releasable latch means, including a platform having a flexible end portion adapted for cooperative engagement with the shroud, for latching the shroud at the second position when the shroud is moved to the second position and for releasing the shroud from the second position, responsive to flexing the flexible end portion, permitting the biasing forces to return the shroud to the first position.

2. An antenna apparatus in accordance with claim 1 further comprising means for restraining the shroud when the flexible end portion is flexed whereby the flexible end portion and the shroud disengage.

3. An antenna apparatus in accordance with claim 1 wherein the shroud substantially covers the first antenna portion.

4. An antenna apparatus in accordance with claim 1 wherein the first antenna portion further comprises a helix having a variable helical length.

5. An antenna apparatus in accordance with claim 1 further comprising means for limiting movement of the first antenna portion about a central axis of the first antenna portion.

6. An antenna apparatus in accordance with claim 1 further comprising a second antenna portion having a fixed physical dimension; and means for coupling the first antenna portion and the second antenna portion.

7. An antenna apparatus in accordance with claim 6 wherein the means for coupling further comprises means for releasably coupling the first and second antenna portions.

8. An antenna apparatus in accordance with claim 7 wherein the means for releasably coupling further comprises:

a first connector coupled to the first antenna portion; and a second connector coupled to the second antenna portion and adapted for connecting to the first connector.

9. An antenna apparatus in accordance with claim 6 wherein the first and the second antenna portions are positioned in tandem.

10. An antenna apparatus in accordance with claim 6 wherein the shroud substantially covers the second portion of the antenna.

11. An antenna apparatus comprising:

a shroud moveable between at least a first and a second position;

an antenna having a first and a second portion, the first portion having a first physical dimension when the shroud is moved to the first position and a second physical dimension when the shroud is moved to the second position, and exerting biasing forces on the shroud when the shroud is moved to the second position to urge the shroud towards the first position, the second portion having a fixed physical dimension;

means for releasably coupling the first antenna portion and the second antenna portion; and releasable latch means for latching the shroud at the second position when the shroud is moved to the second position and for releasing the shroud from the second position permitting the biasing forces to return the shroud to the first position.

12. An antenna apparatus in accordance with claim 11 wherein the releasable latch means further comprises a platform having a flexible end portion adapted for cooperative engagement with the shroud.

13. An antenna apparatus in accordance with claim 12 further comprising means for restraining the shroud when the flexible end portion is flexed whereby the flexible end portion and the shroud become disengaged.

14. An antenna apparatus in accordance with claim 11 wherein the shroud substantially covers the first antenna portion.

15. An antenna apparatus in accordance with claim 11 wherein the first antenna portion further comprises a helix having a variable helical length.

16. An antenna apparatus in accordance with claim 11 further comprising means for limiting movement of the first antenna portion a central axis.

17. An antenna apparatus in accordance with claim 11 wherein the means for releasably coupling further comprises:

a first connector coupled to the first antenna portion; and a second connector coupled to the second antenna portion and adapted for connecting to the first connector.

18. An antenna apparatus in accordance with claim 11 wherein the first and the second antenna portions are positioned in tandem.

19. An antenna apparatus in accordance with claim 11 wherein the shroud substantially covers the second portion of the antenna.

20. A wireless communication device comprising:

radio circuitry means; and an antenna apparatus coupled to the radio circuitry means, including:

a shroud moveable between at least a first and a second position;

a first antenna portion having a first physical dimension when the shroud is moved to the first position and a second physical dimension when the shroud is moved to the second position, and exerting biasing forces on the shroud when the shroud is moved to the second position to urge the shroud towards the first position; and releasable latch means, including a platform having a flexible end portion adapted for cooperative engagement with the shroud, for latching the shroud at the second position when the shroud is moved to the second position and for releasing the shroud from the second position, responsive to flexing the flexible end portion, permitting the biasing forces to return the shroud to the first position.

21. A wireless communication device comprising:

radio circuitry means; and an antenna apparatus coupled to the radio circuitry means, including:

a shroud moveable between at least a first and a second position;

an antenna having a first and a second portion, the first portion having a first physical dimension when the shroud is moved to the first position and a second physical dimension when the shroud is moved to the second position, and exerting biasing forces on the shroud when the shroud is moved to the second position to urge the shroud towards the first position, the second portion having a fixed physical dimension;

means for releasably coupling the first antenna portion and the second antenna portion; and releasable latch means for latching the shroud at the second position when the shroud is moved to the second position and for releasing the shroud from the second position permitting the biasing forces to return the shroud to the first position.

* * * * *